US007888575B1

(12) United States Patent
Toscano

(10) Patent No.: US 7,888,575 B1
(45) Date of Patent: Feb. 15, 2011

(54) PERCUSSION INSTRUMENT

(76) Inventor: Elisandro Toscano, 311 S. Greengrove Dr., Orange, CA (US) 92866

( * ) Notice: Subject to any disclaimer, the term of this patent is extended or adjusted under 35 U.S.C. 154(b) by 0 days.

(21) Appl. No.: 12/460,274

(22) Filed: Jul. 15, 2009

Related U.S. Application Data

(60) Provisional application No. 61/134,882, filed on Jul. 15, 2008.

(51) Int. Cl.
*G10D 13/02* (2006.01)

(52) U.S. Cl. ..... 84/413

(58) Field of Classification Search ..... 84/415, 84/411 R, 413
See application file for complete search history.

(56) References Cited

U.S. PATENT DOCUMENTS

| | | | | | |
|---|---|---|---|---|---|
| 324,881 | A | * | 8/1885 | Perry | 84/415 |
| 388,527 | A | * | 8/1888 | Buckbee, Jr. | 84/415 |
| 399,396 | A | * | 3/1889 | Fry | 84/415 |
| 1,204,182 | A | | 11/1916 | O'Connor | |
| 2,080,346 | A | * | 5/1937 | Tainton | 106/403 |
| 2,425,996 | A | * | 8/1947 | Cordes | 84/411 R |
| 2,433,200 | A | * | 12/1947 | Cordes | 84/415 |
| 3,427,915 | A | * | 2/1969 | Mooney | 84/275 |
| 3,439,573 | A | | 4/1969 | Zottolo | |
| 3,478,634 | A | * | 11/1969 | Haerich | 84/193 |
| 4,079,657 | A | * | 3/1978 | Sobreira | 84/411 R |
| 4,138,920 | A | * | 2/1979 | Meador | 84/415 |
| 4,520,709 | A | * | 6/1985 | Kester, Jr. | 84/415 |
| 4,967,634 | A | * | 11/1990 | Whynott | 84/413 |
| 5,739,448 | A | * | 4/1998 | Toscano | 84/413 |
| 5,977,463 | A | * | 11/1999 | Bartlett | 84/413 |
| 6,300,551 | B1 | * | 10/2001 | Adinolfi | 84/411 R |
| 6,700,046 | B2 | * | 3/2004 | Cherbettchian | 84/415 |
| 7,223,910 | B2 | * | 5/2007 | Shimada | 84/415 |
| 7,361,823 | B2 | * | 4/2008 | Rush | 84/411 R |
| 7,501,567 | B1 | * | 3/2009 | Spinazzola | 84/411 R |
| 7,642,441 | B2 | * | 1/2010 | Cohen | 84/411 R |
| 7,777,112 | B2 | * | 8/2010 | O'Connor | 84/411 R |
| 2009/0038465 | A1 | * | 2/2009 | Whalley et al. | 84/415 |

* cited by examiner

*Primary Examiner*—Elvin G Enad
*Assistant Examiner*—Robert W Horn
(74) *Attorney, Agent, or Firm*—Cisto & Thomas, LLP

(57) ABSTRACT

An improved drum construction in which sound hindering hardware is removed from the drum shell utilizing a unique tuning system that allows the drum skin to be tuned by rotating a counterhoop to bear pressure on an annular hoop securing the drum skin against a bearing rim. Rotation of the counterhoop drives the annular hoop deeper into an annular channel thereby increasing the tautness of the drum skin across the bearing rim. The bearing rim may be modified with adjustable bearing edges. The drum strainer is also removed from the drum shell and attached to the rim or counterhoop. Tone bridges and tone coats may be added to the drum shell to enhance sound production.

37 Claims, 12 Drawing Sheets

PERCUSSION INSTRUMENT

CROSS-REFERENCE TO RELATED APPLICATION (Delete for PCT)

This patent application claims the benefit of U.S. Provisional Patent Application Ser. No. 61/134,882, entitled "Improved Percussion Instrument," filed Jul. 15, 2008, which application is incorporated in its entirety here by this reference.

BACKGROUND OF THE INVENTION

1. Technical Field

This invention relates to percussion instruments improved by reducing hardware on the drum shell.

2. Background

Current percussion instruments, such as the snare drums require extensive hardware, such as holder clamps, tension rods, lugs, foot pads, and snare butts, on the drum shell for tuning the drum skin and adjusting the snare. The hardware applies radial force on the drum shell, thereby interfering with the propagation of the sound produced from striking the top of the drum, traveling from the top drum skin, through the drum shell, to the bottom of the drum. The propagation of the sound as it resonates throughout the drum contributes to the sound quality of the drum.

In addition to the interference with sound production, the hardware limits the versatility of the drum. For example, removing the drum skin requires loosening numerous lugs and tension rods. Releasing the snare requires loosening the tension in the snare wires, thereby increasing the susceptibility to a slap back in which the loose snare wires may flail around uncontrollably and on occasion slap the drum skin creating unwanted sounds.

As such, there is a need for a new type of drum in which hardware can be removed from the drum shell to improve sound production and increase versatility of drum construction.

BRIEF SUMMARY OF INVENTION

The present invention is directed to an improved drum construction in which sound hindering hardware is removed from the drum shell. Most hardware attached to the drum shell is required for tuning the drum and supporting the snare system. The present invention replaces the axial force, bearing hardware with a tuning collar, which supports a unique tuning system that allows the drum skin to be tuned by rotating a counterhoop to bear pressure on an annular hoop securing the drum skin against a bearing rim. Rotation of the counterhoop drives the annular hoop deeper into an annular channel thereby increasing the tautness of the drum skin across the bearing rim.

Utilizing this type of tuning system allows the improved drum to remove any hardware related to tuning the drum skin. In addition, the improved drum attaches the snare system to the unique tuning system (or the rim of traditional drums) rather than the drum shell. The tuning system also allows for easier modification of the bearing rim and bearing edge, including modifying the angle of the bearing rim and the positioning of the bearing edge. The bearing edge may also be removable. Furthermore, in place of the hardware bearing axial force, the improved drum may comprise hardware, such as external plating and tone coats that facilitate propagation of sound through the drum. The counterhoop may also be threaded to screw on additional drums also containing threads. Finally, with the hardware removed, there is more versatility in the shape of the drum shell.

DETAILED DESCRIPTION OF THE INVENTION

The detailed description set forth below in connection with the appended drawings is, intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
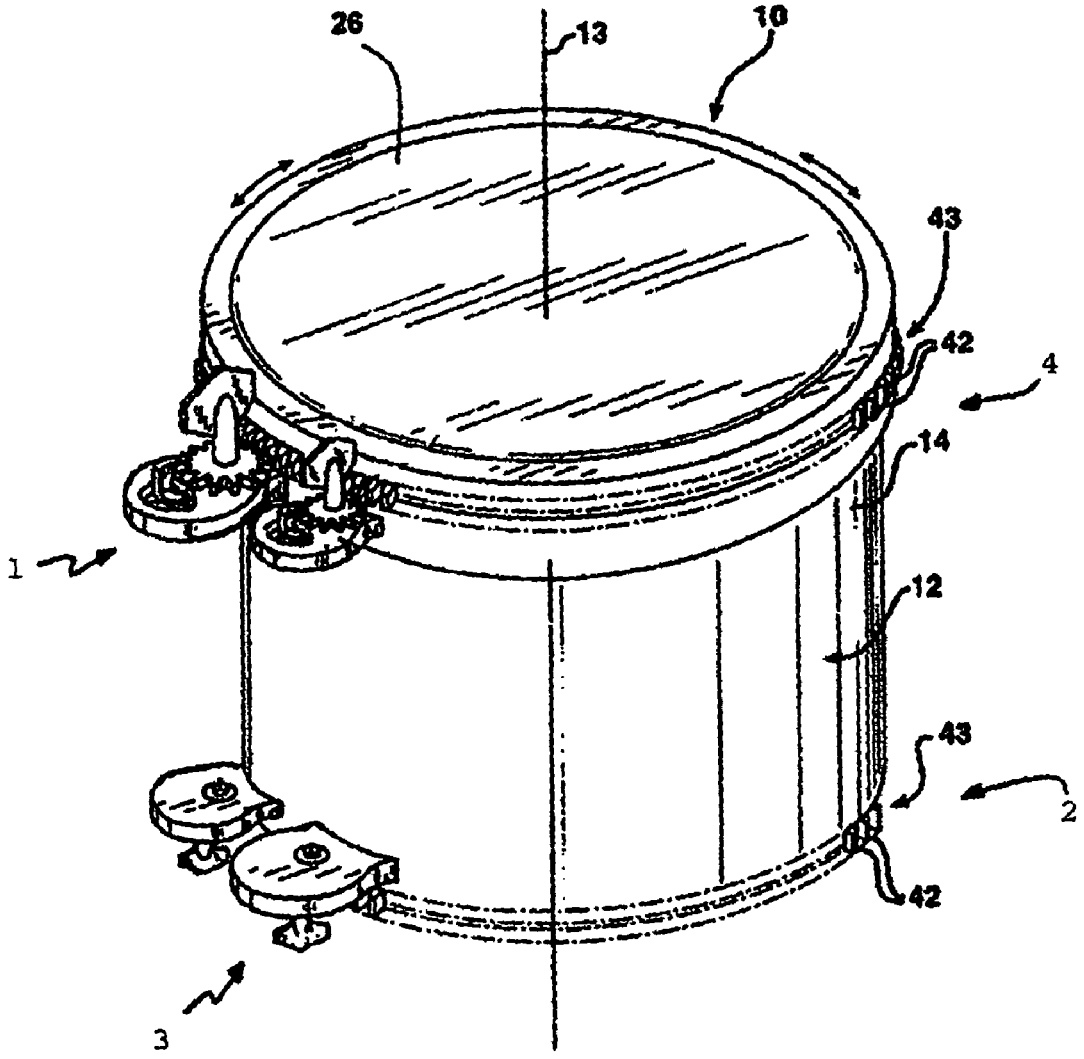
FIG. 1 is a perspective view of an embodiment of the present invention.

The present invention is directed towards percussion instruments with improved sound qualities and increased versatility achieved by minimizing the drum hardware attached to a drum shell 12. Note, these drawings are not drawn to scale and are provided to illustrate the concept. FIG. 1 illustrates a musical percussion drum improved according the present invention. The drum 10 comprises a drum shell 12 having a cylindrical, outer wall 14 that extends longitudinally in both directions about a drum shell axis 13 defining first and second ends 2, 4 of the drum 10, relatively speaking, the upper and lower extremities of the drum 10. A drum skin 26 is stretched over and secured to the first end. Typical drum hardware used to fasten the drum skin 26 to the drum shell 12 such as holder clamps, tension rods, lugs, foot pads, and snare butts or strainers are removed from the drum shell 12 so that sound vibrations can resonate better throughout the drum shell 12 than conventional drums. With the drum shell 12 free of interference from traditional hardware, the drum produces sound as an integral unit.

Rather than using tension rods and lugs attached to the drum shell 12 to tune the drum 12, the tuning system provided in U.S. Pat. No. 5,739,448, incorporated herein by this reference, may be utilized.

Figure 2:
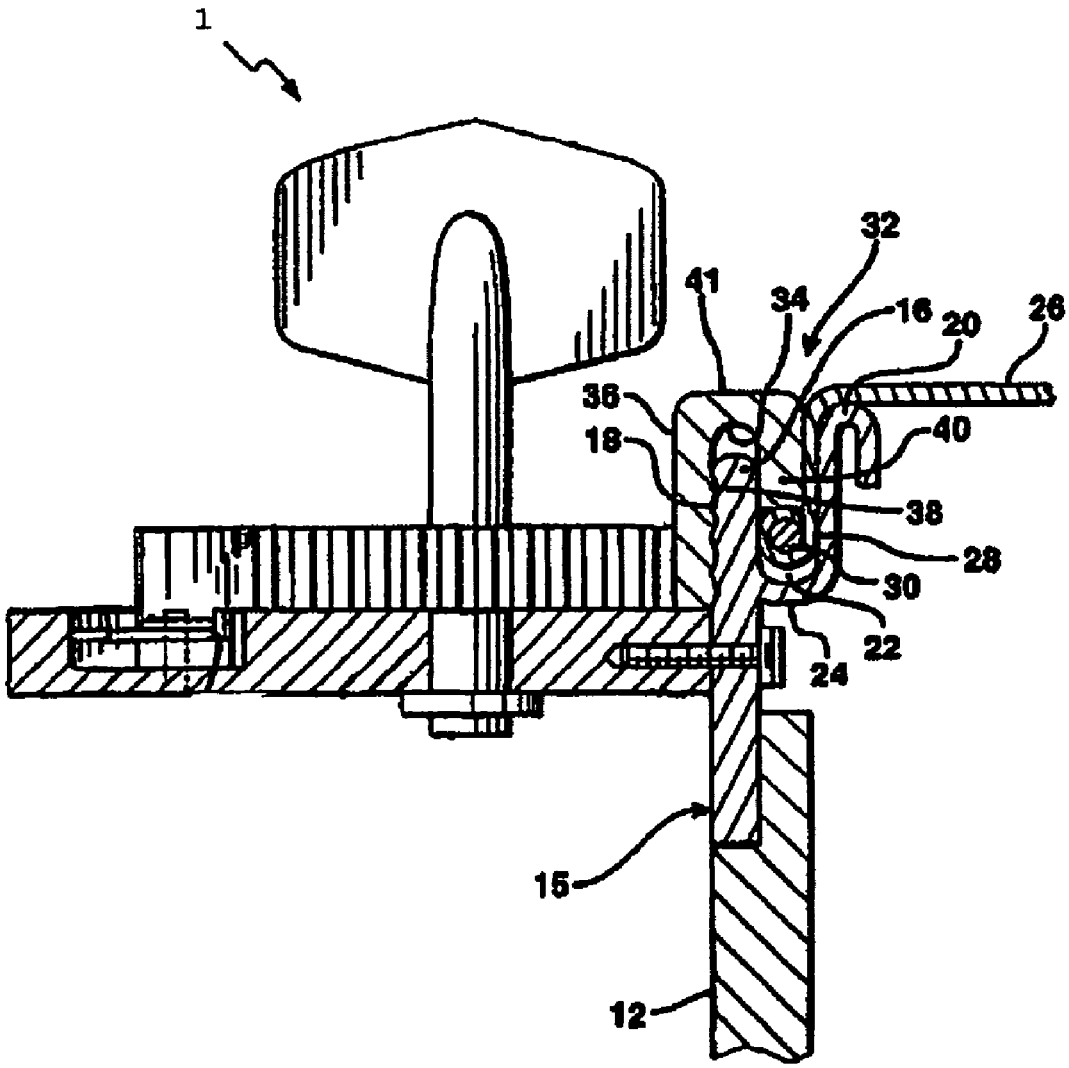
FIG. 2 is a close up partial cross-sectional side view of an embodiment of the tuning system of the present invention.

Briefly, referring to FIGS. 1 and 2, the tuning system comprises a tuning collar 15 attached to the drum shell 12, an annular hoop 30 to secure the drum skin 26 to the tuning collar 15, and an annular counter hoop 32 to secure the annular hoop 30 to the tuning collar 15 to tune the drum skin 26.

The tuning collar 15 is permanently secured to the drum shell 12 such as with an epoxy adhesive. In some embodiments, the tuning collar 15 is press fit onto the drum shell 12. It is believed that having the tuning collars 15 press fit onto the drum shell facilitates the transference of the energy from rim shots (hitting the rim of a conventional drum or, a counterhoop 32 of the current invention, with the drum sticks) into the drum shell 12.

The tuning collar 15 comprises a tuning rim 16. The tuning rim 16 has a radially outwardly facing outer surface 18 with screw threads defined thereon coaxially relative to the axis 13 of the drum shell 12. The tuning collar 15 also has an annular bearing rim 20 disposed coaxially within the tuning rim 16 and separated therefrom by an annular channel 22. The tuning rim 16 and the bearing rim 20 are rigidly joined together by a curved connecting region 24.

The drum 10 also comprises a conventional, expansive drum skin 26. The drum skin 26 resides in contact with the bearing rim 20 throughout its circumference. The drum skin 26 has a peripheral region 28 extending radially outwardly beyond the bearing rim 20 and into the channel 22.

The closed, annular hoop 30 of circular cross section is secured to the peripheral region 28 of the drum skin 26 and resides in the channel 22. The peripheral region 28 may be held against the annular hoop 30 either by adhesive, or merely by the force of friction. In any event the peripheral region 28 of the drum skin 26 is firmly attached to and immobilized relative to the hoop 30.

An annular counterhoop 32, having an inverted, generally U-shaped cross section (including J-shapes and other hook-like shapes) is formed with a downwardly facing, annular groove 34 therein that receives the tuning rim 16. The counterhoop 32 has an outer tensioning band 36 with radially inwardly directed screw threads 38 defined thereon. The counterhoop 32 also includes an inner, annular pressure ring 40 that resides in the channel 22 and bears longitudinally against the hoop 30. A connecting web or bridging portion 41 rigidly joins the tensioning band 36 to the pressure ring 40. The bridging portion 41 spans the tuning rim 16 and passes thereover in spaced, longitudinal separation therefrom. The drum skin 26 is tightened across the bearing ring 20 by rotating the tensioning band 36 further onto the tuning rim 16 and is loosened by rotating the tensioning band 36 from the tuning rim 16 in the reverse direction. Rotation of the tensioning may be accomplished using, for example, a gear system as shown in the tuning system 1.

Thus, due to the unique tuning feature, the drum 10 is designed to be tuned with minimal hardware attached to the side of the drum shell 12 to improve drum resonating and sound production quality and versatility. Eliminating the drum hardware from the side of the drum shell 12 allows for a variety of modifications and features to improve drum construction and sound quality.

Figure 3A:
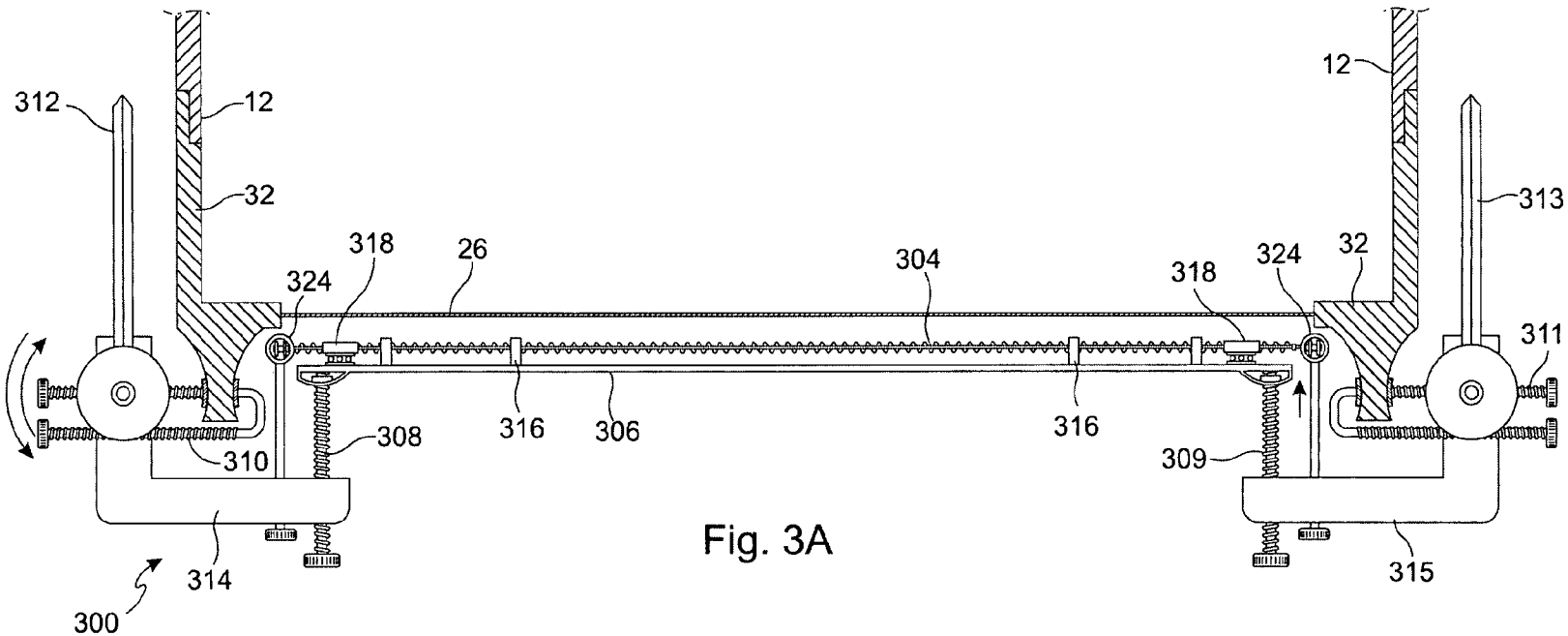
FIG. 3A shows a side view of an embodiment of the strainer system.

For example, in conventional snare drums, the snare system passes through the drum rim and attaches to the drum shell. This is not a problem in conventional drums since the drum rim is fixed to the drum shell. In the present invention, the counterhoop 32 (the drum rim counterpart to conventional snare drums) moves relative to the drum shell 12. Therefore, one modification from conventional drums, as shown in FIG. 3A, is to remove the snare strainer system 300 from the drum shell 12 and operatively connect the snare strainer system 300 to the counterhoop 32 so that the snare can rotate with the counterhoop 32. In embodiments not utilizing the unique tuning system, the strainer system 300 may be attached to a shell ring.

A snare strainer system 300 is located at the bottom drum skin 26 expanding across the diameter of the drum 10. The entire strainer system 300 is attached to the counterhoop 32 in drums utilizing the tuning system described in U.S. Pat. No. 5,739,448, of the shell ring or rim in conventional snare drums. This improved placement allows better resonance of the drum shell 10 during play by reducing the hardware attached to the drum shell.

Figure 3B:
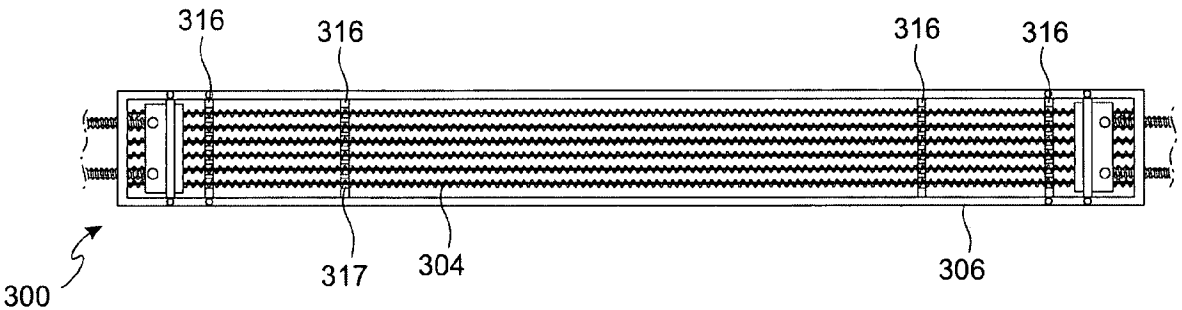
FIG. 3B is a top view of a strainer of the present invention.

As shown in FIGS. 3A and 3B, the snare strainer system 300 comprises a cradle 306, a strainer 304 stretched across the length of the cradle 306; and a cradle adjustment system to move the cradle 306 and strainer 304 relative to the drum skin 26. The cradle adjustment system comprises a first endplate 314 and a second endplate 315 opposite the first endplate 314. Each endplate comprises a clamp 310, 311 attaching the endplates 314, 315 to the drum 12, preferably at the counterhoop 32, a throw-off lever 312, 313 operatively connecting the endplates 314, 315 to the clamp 310 to toggle the endplate 314 between a first position that places the cradle 306 against the drum skin and a second position that places the cradle 306 away from the drum skin 26. Each endplate 314, 315 further comprises a cradle adjustment member 308, 309 having a first and second end 320, 322. The first end 320 of the cradle adjustment member 308 is movably connected to the endplate 314 and the second end 322 of the cradle adjustment member 308 is connected to the cradle 306.

The strainer 304 is stretched across the drum skin 26 and attached to the cradle 306 at its ends. Within the cradle 304 are tracks 316 to contain the strainer wire 304. The tracks 316 are soft plastic material with grooves 317 in which the strainer wires 304 are positioned. One groove 317 contains a single strainer wire 304. The tracks 316 allow movement of the snare wires in a longitudinal direction towards the drum skin 26 while reducing movement in a lateral direction.

Shims 318 are placed intermittently along the cradle 306 in between the cradle 306 and the strainer 304. The shims 318 provide shock absorption for the strainer 304 and can be made of rubber, plastic, foam, cork, or other material shock absorbing material.

Figure 3C:
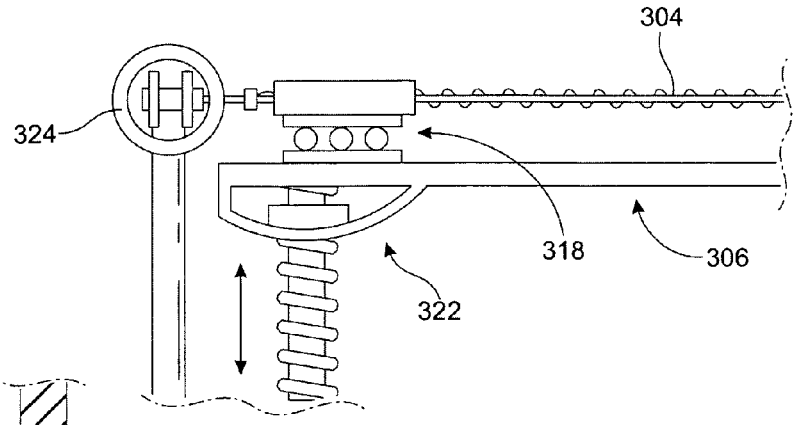
FIG. 3C is a close up side view of an embodiment of the strainer.
Figure 3D:
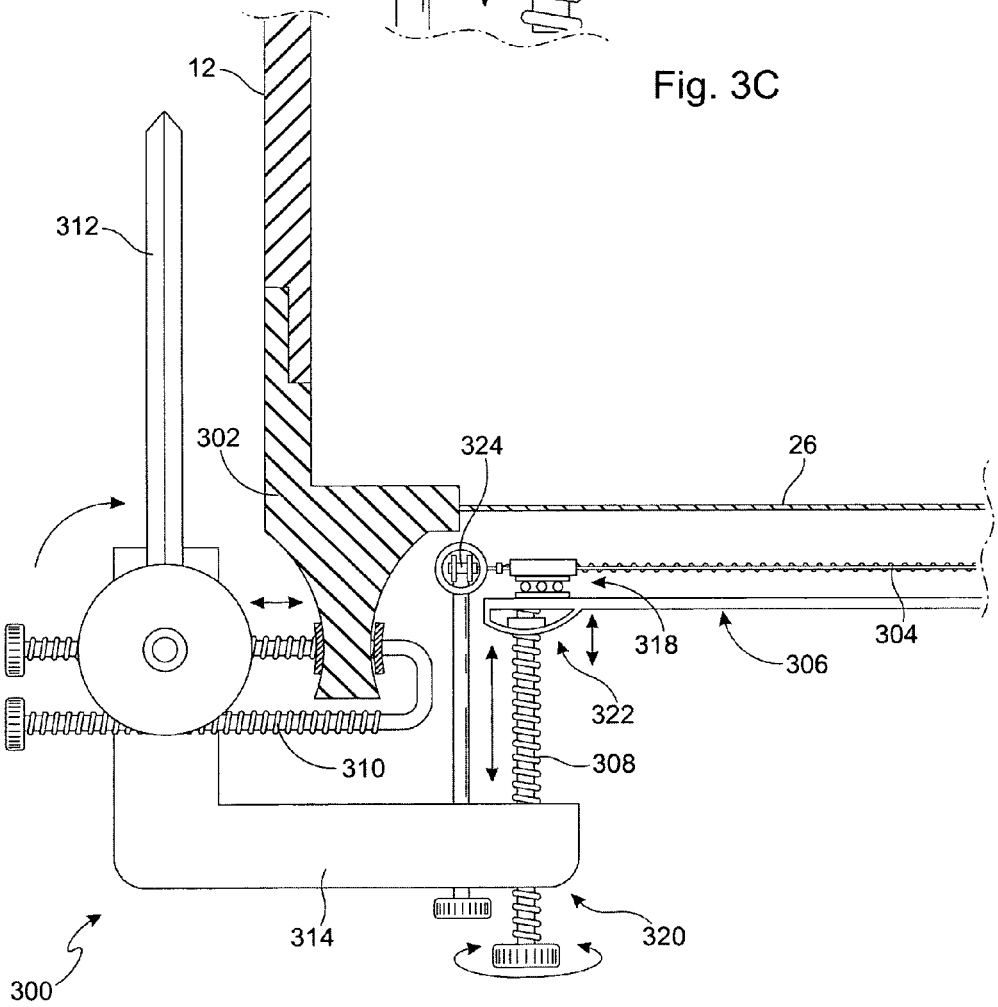
FIG. 3D is a close up side view of an embodiment of the throw-off lever of the strainer system.

As shown in FIGS. 3C and 3D, the cradle 306 is supported by the cradle adjustment member 308. Although shown and described for one side, analogous structures exist on the opposite side. The first end 320 of the cradle adjustment member 308 is movably secured to the endplate 314 and the second end 322 of the cradle adjustment member 308 is secured to the cradle 306. The cradle adjustment member 308 moves longitudinally, parallel with the drum shell axis 13 through the endplate 314 to move the cradle 306 proximal or distal to the drum skin 26. The cradle adjustment member 308 may utilize a ratchet and pawl mechanism or be threaded like a screw so as to incrementally adjust the distance between the strainer 304 and the drum skin 26.

The clamp 310 is secured to the counterhoop 32 or shell ring 302. The clamp 310 may also utilize a ratchet and pawl mechanism or other vice grip-type mechanism to secure itself to the counterhoop 32 or shell ring 302. The clamp 310 further comprises a throw-off lever 312 to quickly and easily release the snares 304 from being abutted against the drum skin 26. In some embodiments, the throw-off lever 312 may adjust the positioning of the cradle 306 by moving the endplate 314. In other embodiments, the throw-off lever 312 may adjust the positioning of the cradle 306 by, for example, adjusting the positioning of the clamp 310.

The snare strainer system 300 may further comprise a tension spool 324 or tension pulley. The tension spool 324 allows the snare tension to be adjusted. In some embodiments, the snare system 300 may have two tension spools 324, one on opposite sides of the cradle 306. The tension spool 324 may be attached to the cradle 306, the endplate 314, or the cradle adjustment member 314. The snares 304 are securely wrapped around the spool 324 and can be tightened or loosened by rotating the spool 324. The spool 324 may use a ratchet and pawl mechanism for incrementally adjusting the tension of the snares 304.

The addition of the spool 324 improves the strainer system 300 over the prior art in that when the throw-off lever 312 is released, the strainer 304 can be moved away from the drum skin 26 while the tension in the strainer 304 is maintained, thereby eliminating any slap back action as experienced by other strainers in the prior art.

In addition to the modification of the snare strainer system 300, utilizing the improved tuning system provides easy modification of the bearing rims 20 and bearing edges 21 for more versatile sound production. The portion of the bearing rim 20 making contact with the drum skin 26 is the bearing edge 21. The bearing edge 21 resides in contact with the drum skin 26 throughout its circumference. The closed, annular hoop 30 secures the drum skin 26 and resides in the channel 22. The peripheral region 28 may be held against the annular hoop 30 either by adhesive, or merely by the force of friction. In any event the peripheral region 28 of the drum skin 26 is firmly attached to and immobilized relative to the hoop 30. As such, by removing the annular hoop 30, the drum skin 26 may be easily removed to alter the bearing rim 20 or bearing edge 21.

Figure 4A:
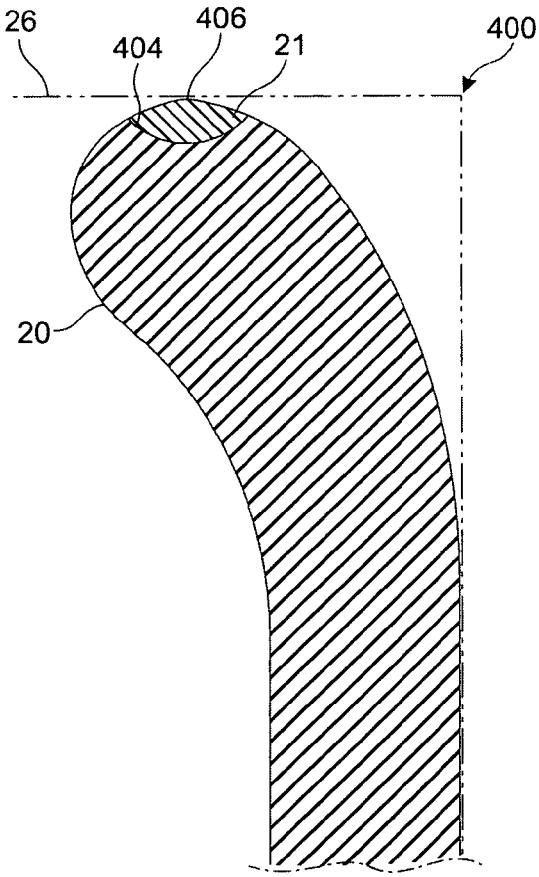
FIG. 4A is a close up cross-sectional side view of an embodiment of the bearing rim.

In conventional drums, the drum skin 26 has a fold 400 such that the bearing edge 21 is wedged into the drum skin fold 400. In some embodiments of the present invention, the bearing edge 21 is positioned away from the drum skin fold 400 as shown in FIG. 4A. In other words, the bearing edge 21 may point toward the drum shell axis 13 rather than into the drum skin fold 400. Depending on the positioning of the bearing edge 21, the sound characteristics produced by the drum 10 may vary. The positioning of the bearing edge 21 may be modified by using different designs of the bearing rim 20. For example, a bearing rim 20 may have an elliptically inward-curving shape as shown in FIG. 4A.

Figure 5A:
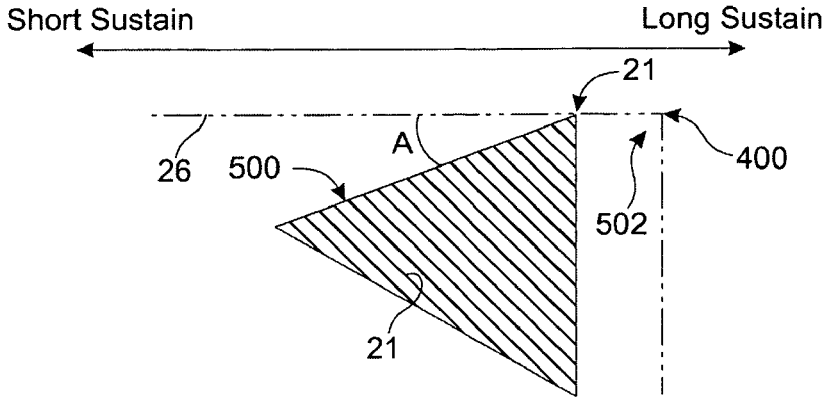
FIGS. 5A-C are a series of side views of other embodiments of the bearing rim.
Figure 5B:
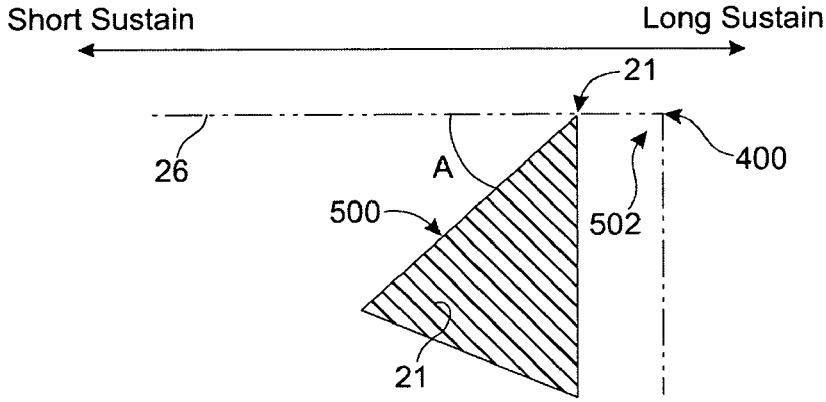
Figure 5C:
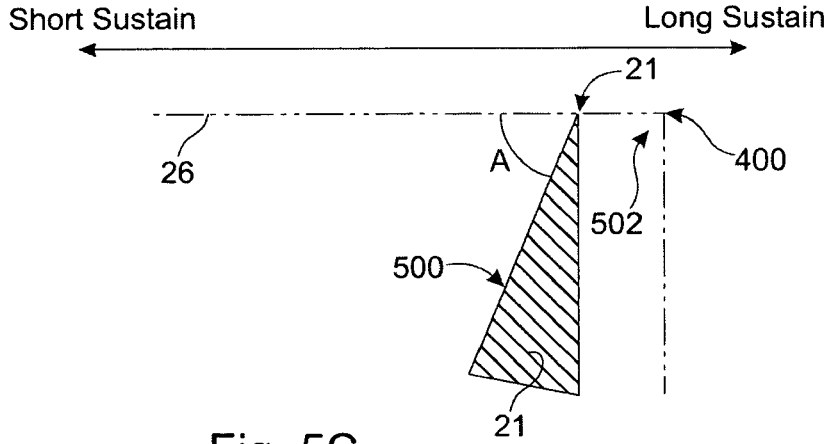

In some embodiments, the bearing edge 21 is triangularly shaped such that the base 404 sits on top of the bearing rim 20 and the apex 406 contacts the drum skin 26. As shown in FIG. 5, the bearing edge 21 further comprises a proximal surface 500 that slopes radially inward towards the drum shell axis 13 and a distal surface 502 that slopes radially away from the drum shell axis 13. In some embodiments, the proximal surface 500 or the distal surface 502 may have no slope, in other words, the proximal or distal surface may be parallel to the drum shell axis 13. Thus, an angle A is created between the proximal surface 500 and the drum skin 26.

In addition to the positioning of the bearing edge 21, the angle A created between the proximal surface 500 of the bearing edge 21 and the drum skin 26 may also provide sounds with different characteristics. For example, the smaller the angle A or as the proximal surface 500 of the bearing edge 21 approaches zero or horizontal, the shorter a sound can be sustained. Conversely, the larger the angle A or as the proximal surface 500 becomes more vertical, the longer a sound can be sustained. Thus, the angle A can range from approximately 0 degrees (completely horizontal to approximately 90 degrees (completely vertical). Preferably, the angle A is greater than 0 degrees and less than 90 degrees. Therefore, the sound characteristics may be altered by changing the position of the bearing edge 21, changing the bearing edge angle A, or both.

To further enhance the resonance and transference of energy, the bearing rim 20 and/or bearing edge 21 may be made of high tension spring steel. The concussive force from striking such a bearing edge 21 returns kinetic energy into the drum head as an enhancement to extended vibration and increased ambience.

Figure 4B:
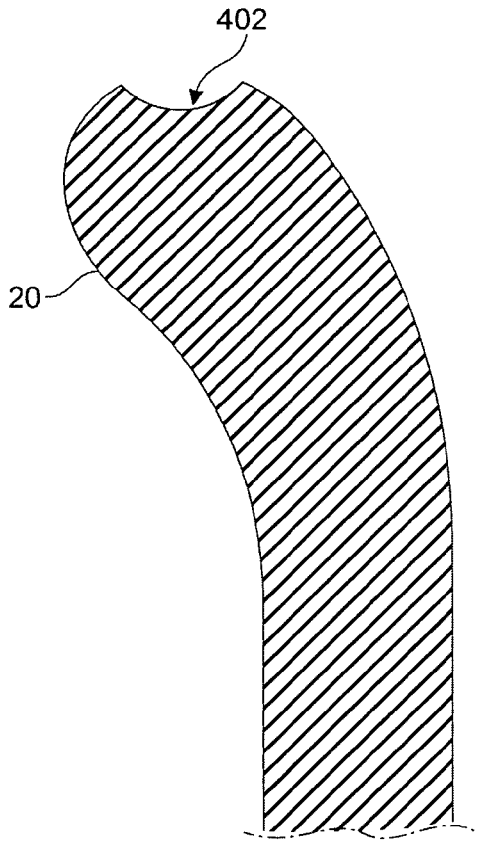
FIG. 4B is a close up cross-sectional side view of the bearing rim of FIG. 4A with the bearing edge removed.

In some embodiments, the bearing edge 21 may be removable as shown in FIG. 4B. The bearing rim 20 may have a groove 402 into which a bearing edge 21 may be press fit. FIG. 4A shows a side view of the bearing rim 20 with a removable bearing edge 21 inserted. FIG. 4B shows a side view of the removable bearing edge 21 removed from the bearing rim 20. Note, these drawings are not drawn to scale and are provided to illustrate the concept. Due to the removability of the bearing edges, bearing edges 21 made of different material may be interchanged within a single drum 10. Changing the material of the bearing edge 21 would affect the tone, timbre and sound envelope. Examples of materials that may be used to construct bearing edges 21 include woods, in particular, hardwoods, metals and minerals. A non-exhaustive list includes ebony, rosewood, bell brass, bronze, synthetic sapphire, ceramics, etc. Manufacturing the bearing edge 21 out of a metal would improve the durability of the bearing edge 21. Utilizing sapphire allows the drum 10 to resonate better, sustain a note longer, and tune easier due to the decreased friction between the drum skin 26 and the sapphire bearing edge 21. The addition of a removable bearing edge 21 may further increase the roundedness of the shell 12 by preventing warping.

Figure 6A:
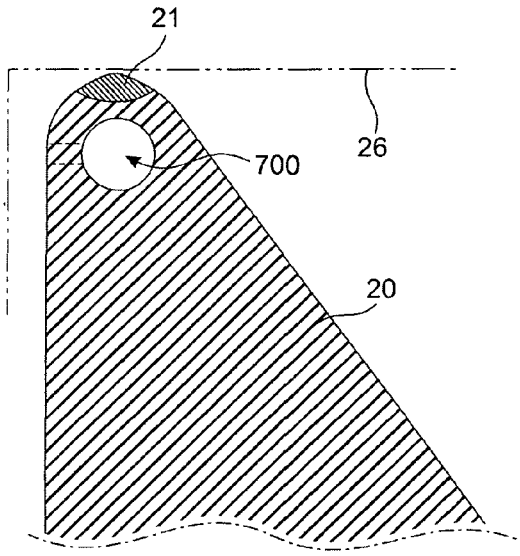
FIG. 6A is a close-up of a partial cross-sectional side view of another embodiment of the bearing rim.
Figure 6B:
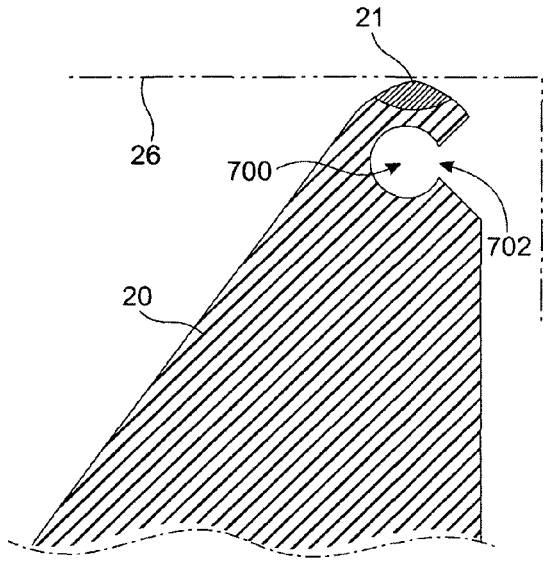
FIG. 6B is a close-up of a partial cross-sectional side view of another embodiment of the bearing rim.

To further modify the sound characteristics of a rimshot, the bearing rim 20 may further comprise a tunnel 700 passing through the entire perimeter of the bearing rim 20, just below the bearing edge 21 as shown in FIGS. 6A and 6B. The hollowness of the tunnel 700 allows the rimshot to ring or reverberate through the tunnel 700. Preferably, the bearing rim 20 is made of bell brass or tempered steel. Matching ring tone to shell tone can be improved by analyzing shell tone first and providing bearing rims 20 or bearing edges 21 which reside closely along the harmonic curve of the natural overtone series. With the drum shell 12 free of interference from traditional hardware, the drum produces sound as an integral unit.

Figure 7:
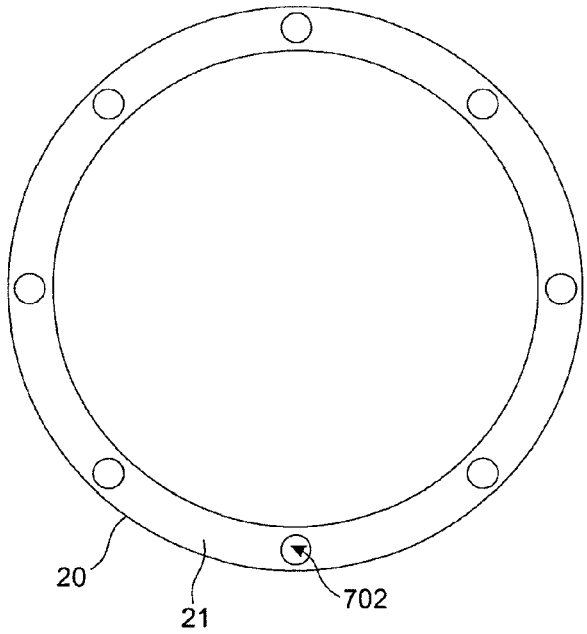
FIG. 7 is a top view of another embodiment of the bearing rim (not drawn to scale)

In some embodiments, air vents 702 may be intermittently dispersed throughout the bearing rim 20. Air vents 702 are holes penetrating through the bearing rim 20 into the tunnel 700. The air vents 702 may be located on the side of the bearing rim 20, as shown in FIG. 6B, or at the top through the bearing edge 21, as shown in FIG. 7.

Another modification to enhance the sound characteristics of a drum 10 is to create a bearing rim 20 from metal alloy in which the grain of the metal alloy is parallel to the grain of the wood that makes up the drum shell 12.

Figure 8A:
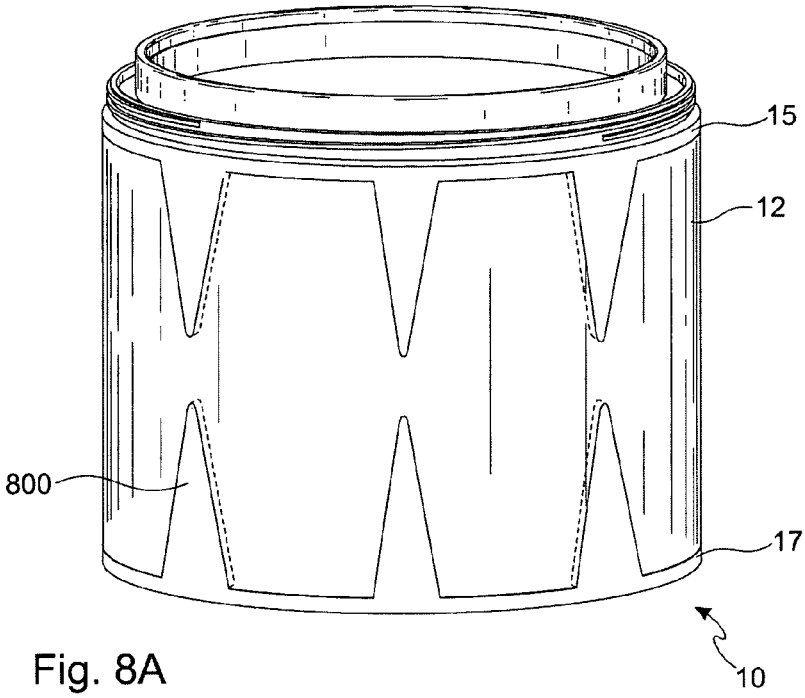
FIG. 8A is a side view of another embodiment of the present invention.
Figure 8B:
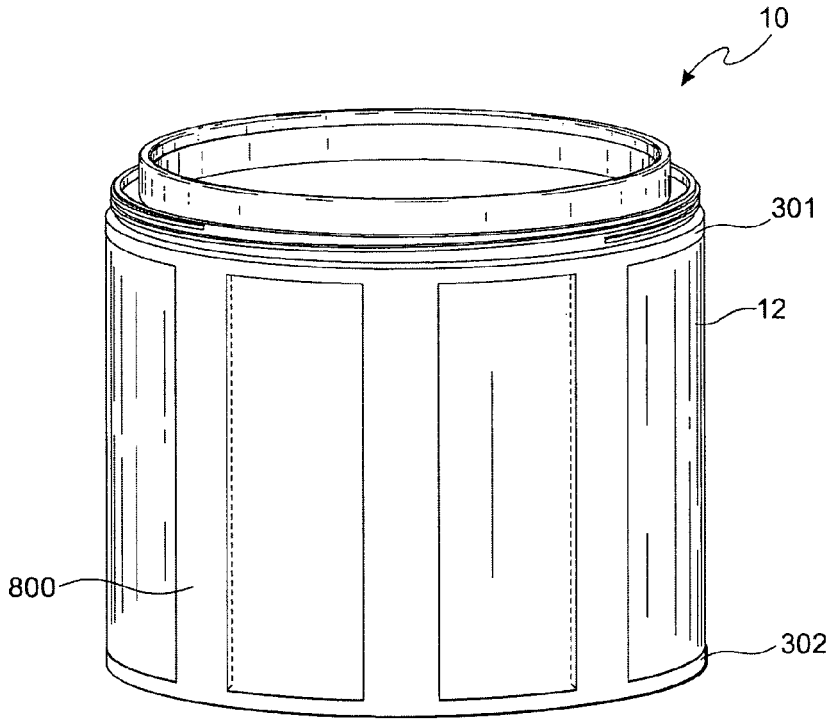
FIG. 8B is a side view of another embodiment of the present invention.

With traditional drum hardware removed from the drum shell 12, the drum shell 12 is opened for adding drum hardware that actually improves sound quality by facilitating sound propagation and resonance rather than impeding them. For example, as shown in FIGS. 8A and 8B, an external plating 800 may be added to the drum shell 12 to further modify or enhance the sound characteristics of a drum 10. An external plating 800 may extend longitudinally from a tuning collar 15 or shell ring 302 along the longitudinal axis of the drum shell 12. The external plating 800 may be of varying shapes, but should, in general run parallel with the grain of the drum shell 12. The external plating 800 may be countersunk into the surface of the drum shell 12 as an extension of the tuning collar 15 or the shell ring. This arrangement between the external plating 800 and drum shell 12 drives high concussive energy into the shell 12. Unlike foot pads on traditional drums, the tone bridges 800 will not exert unwanted perpendicular or radial stress vectors on the shell 12 because the external plating 800 is in effect simply a part of the shell 12 itself, thus transferring concussive energy from the tuning collar 15 or shell ring 302 directly into the shell 12. In addition, the external plating 800 increases the metal content of the drum shell 12 thereby providing a better propagation of sound.

In addition to the enhancement of sound quality, the external plating 800 provides enhanced structural integrity. Since the efficiency of sound travel increases with the density of the material through which the sound is traveling, drummers prefer drum shells 12 that are thicker or made of more dense wood or hardwood. The disadvantage of thick, dense wood is the increased weight. External plating 800 can compensate for this disadvantage by providing structural integrity and strength to the drum shell 12 due to the metal composition of external plating 800. As such, drum shells 12 may be made thinner and any compromise to the structural integrity may be offset by the external plating 800. In addition, drum shells 12 may be made with less dense wood and any compromise to the sound propagation may be offset by the metal external plating 800, which transfer sound energy better than wood.

Thus, with external plating 800, lighter drums can be constructed that produce sounds comparable to heavier more dense drums without external plating. Therefore, unlike traditional drums in which drum hardware impede the propagation of sound, external plating 800 plays an integral part in the sound production.

In some embodiments, the external plating 800 extends all the way from the top tuning collar 15 or shell ring 301 to the bottom tuning collar 17 or shell ring 302, providing the drum shell 12 with maximum energy transference. The bottom drumhead would also be the direct recipient of concussive ring energy, particularly rim shots on the top drumhead, and vice versa. Taken to the extreme, drums 10 in which tone bridges 800 extend from the top tuning collar 15 or shell ring 301 to the bottom tuning collar 17 or shell ring 302 can be made without a drum shell 12. Although resonance may be lost, such a drum 10 could create a very loud, piercing sound that may be valuable in marching bands that play in loud forums. The lightness of the drums 10 would provide more comfort to a drummer Thus, drums may be manufactured very light, weatherproof, and with synthetic shells or no shells, which are very loud for outdoor playing. Tuning collars 15, 17 or shell rings 301, 302 would be extra wide for this purpose and would incorporate ultralight external plating 800. In addition, the application of tone bridges external plating 800 to lighten the weight of drum systems on marching drums eliminates the risk of KEVLAR® type drumskins crushing the drum shells 12 when extra wide shell rings 301, 302 are used.

Figure 9:
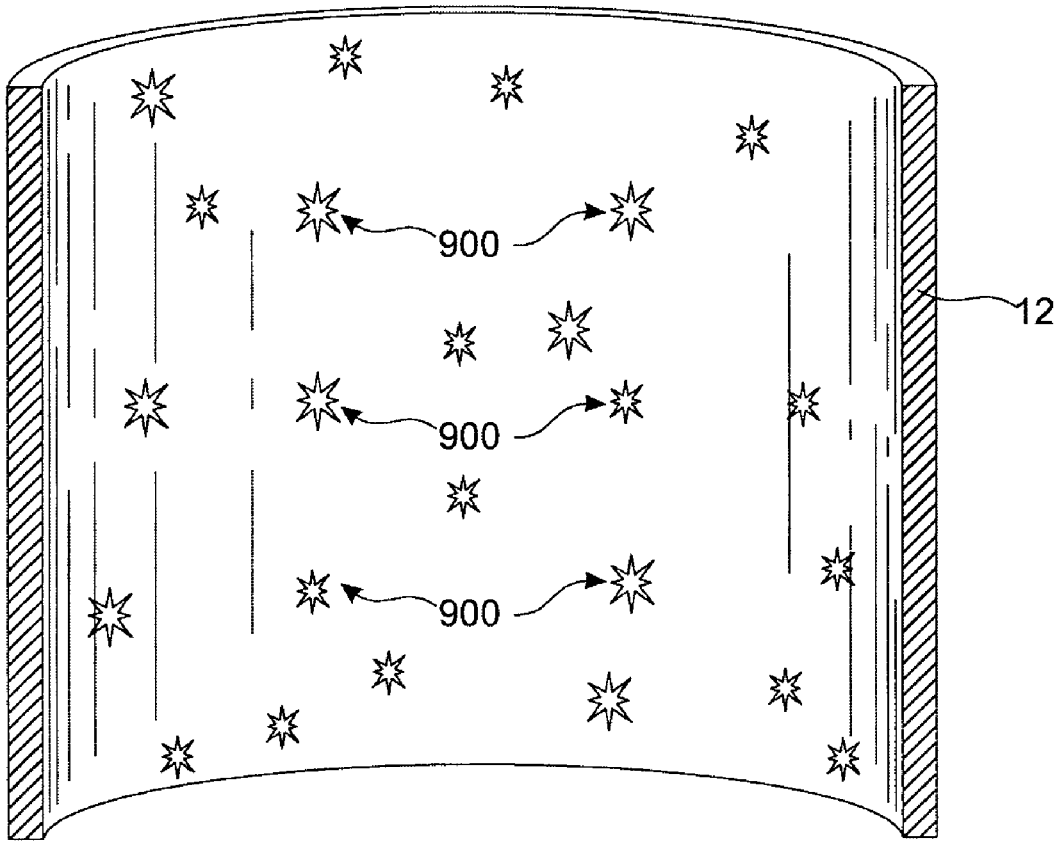
FIG. 9 is a cross-sectional view of an embodiment of a drum shell of the present invention.

Another method of improving the sound quality is to incorporate tone coats 900 into the drum shell 12 as shown in FIG. 9. Tone coats 900 may be comprised of specific mineral or metal content to increase sensitivity and degree of brightness and set a testable standard for harmonic content and variable frequency response when struck, i.e., sine wave shaping, envelope (attack, sustain, decay, and release) and amplitude curve. Minerals, such as glass and/or quartz, and metals, such as steel and/or brass, may be crushed or pulverized into powder form. An adhesive may be applied to the inside or outside of the drum shell 12 and the powdered minerals and metals may be applied to the adhesive. Due to the composition of the tone coats 900, sound propagation or energy transfer is not impeded. In addition, the mineral and metal composition of the tone coats provides a reflective coating that can have aesthetic qualities.

Figure 10A:
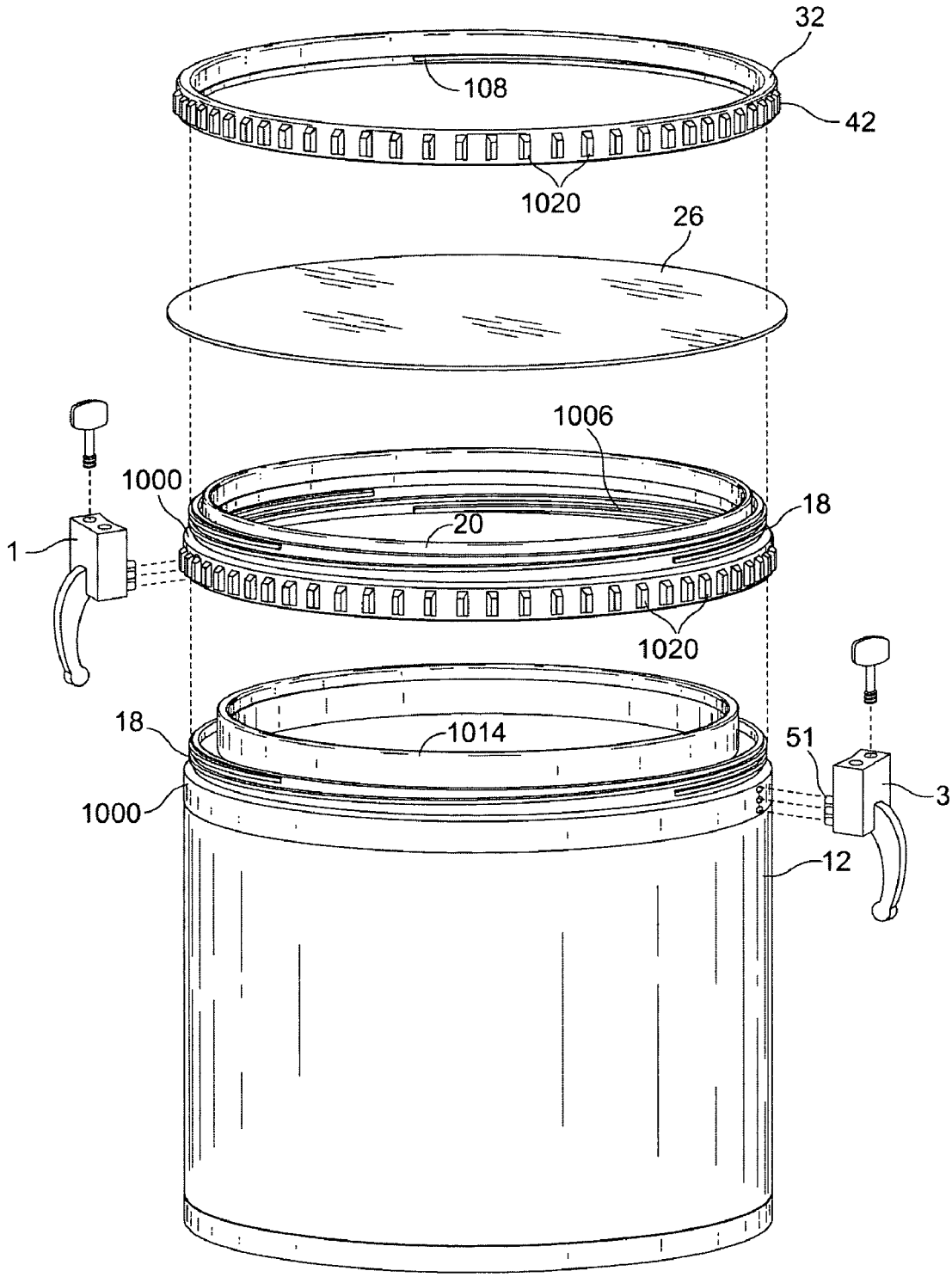
FIG. 10A is an exploded view of an embodiment of the present invention.
Figure 10B:
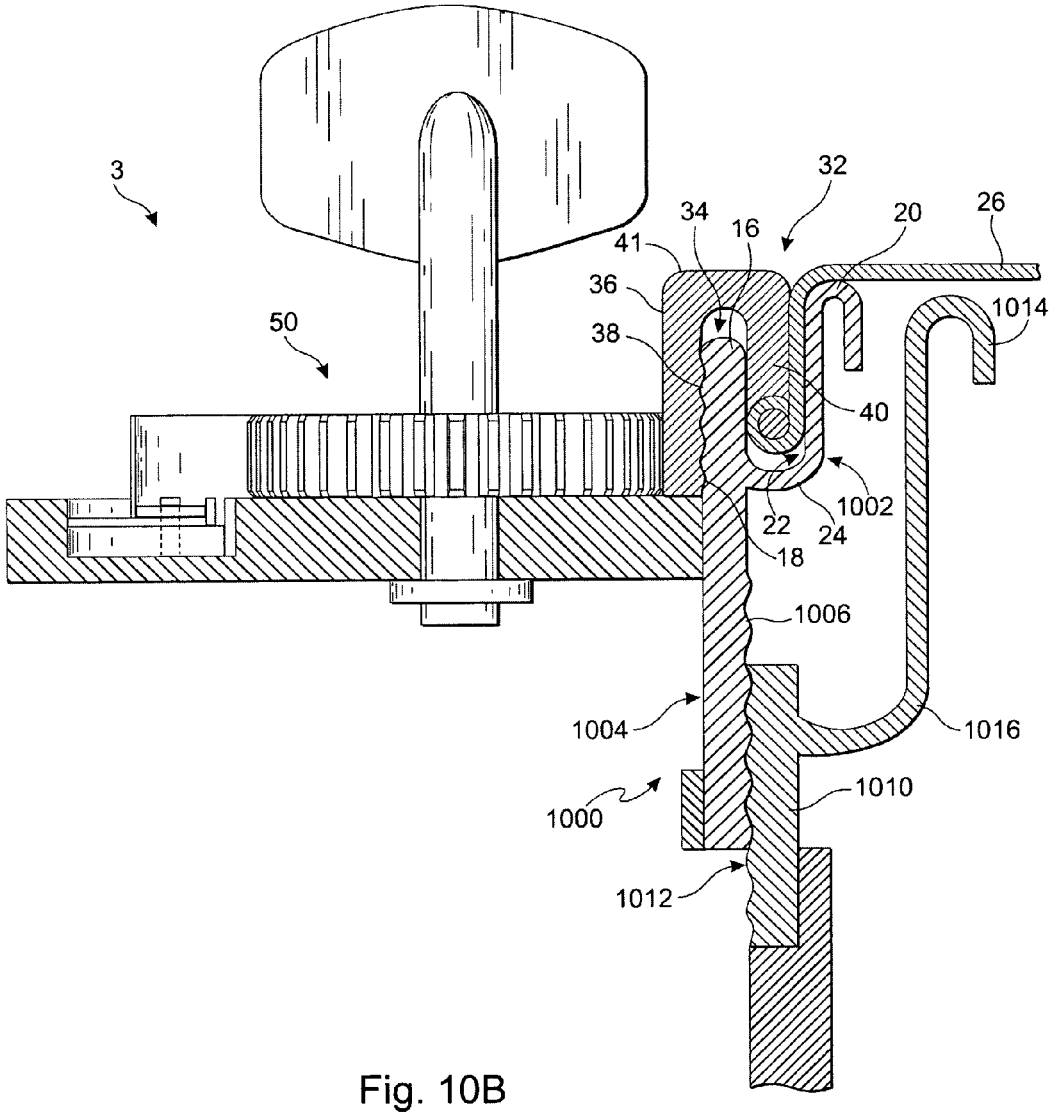
FIG. 10B is a close up cross-sectional side view of another embodiment of the tuning system of the present invention.

Another means for increasing the versatility of sound production from a drum is to create a triple ring tuning system as shown in FIGS. 10A and 10B that allows for the precise tensioning of the drum skin 26 as well as fine control of the amount of pressure the drum skin 26 applies to the drum shell 12. The first ring 32 is similar to the counterhoop with internally-facing threads. Thus, the first ring 32 has an inverted, generally U-shaped (including J-shaped or otherwise hook shaped) cross section formed with a downwardly facing, annular groove 34 therein. The first ring 32 comprises an outer tensioning band 36 with radially inwardly directed screw threads 38 defined thereon, an inner, annular pressure ring 40 parallel to the outer tensioning band 36 and positioned radially inward relative to the outer tensioning band 36, and a bridging portion 41 rigidly joining the outer tensioning band 36 to the pressure ring 40, thereby forming the downwardly facing, annular groove 34.

The second ring 1000 is a modified tuning collar 15 having a first end 1002 and a second end 1004 opposite the first end 1002. The first end 1002 is similar to the tuning collar 15, and therefore, comprises a tuning rim 16 insertable into the downwardly facing, annular groove 34 of the first ring. The first end 1002 also has an externally threaded, radially outwardly facing, outer surface with screw threads 18 operatively engageable with the radially inwardly directed screw threads 38 of the tensioning band 36. The second end 1004 has an internally threaded, radially inwardly facing, inner surface with screw threads 1006 defined coaxially thereon relative to the drum shell axis 13.

The second ring 1000 further comprises an annular bearing rim 20 disposed coaxially with the tuning rim 16 and separated therefrom. A connecting region 24 rigidly joins the tuning rim 16 and the bearing rim 20 together. The tuning rim 16, the annular bearing rim 20 and the connecting region 24 define an upwardly facing, annular channel 22 configured to receive the inner annular pressure ring 40 of the first ring 32. The first ring 32 and the second ring 1000 are operatively connected to control the tensioning of the drum skin 26 as described for the tuning system above.

To increase the versatility of the sound, however, the triple ring tuning system comprises a third ring 1010, which is similar to the tuning collar 15 except that the third ring 1010 has externally-facing threads 1012 and a second bearing rim 1014 attached to the externally-facing threads 1012. The internally-facing threads 1006 of the second ring 1000 operatively engages the externally-facing threads 1012 of the third ring 1010 such that rotation of the second ring 1000 about the third ring 1010 in a first direction (e.g. clockwise) brings the bearing rim 1014 of the third ring 1010 closer to the drum skin 26. Therefore, a connecting region 1016 of the third ring 1010 is configured to position the bearing rim 1014 of the third ring 1010 adjacent to the bearing rim 20 of the second ring 1000 and radially closer to the drum shell axis 13. The second and third ring 1000, 1010 may also comprise a second tuning mechanism 3 as described above to allow the bearing rim 1014 on the third ring 1010 to apply a force against the drum skin 26. Like the tuning collar 15, the third ring may be press fit onto the drum shell 12.

The first tuning system 1 can be fixed to the second ring 1000 and the first gear 50 of the first tuning system 1 engages the first set of teeth 42 of the counterhoop 32 to cause the counterhoop 32 to rotate in a clockwise or counterclockwise direction about the second ring 1000 to tension the drum skin 26 as described above. Similarly, a second tuning system 3 can be fixed to the third ring 1012 with a second gear 51 configured to engage a second set of teeth 1020 on the second ring 1000 to rotate the second ring 1000 about the third ring 1010. Such rotation allows the second ring 1000 to move axially up or down the third ring 1010. Such movement causes the bearing rim 1014 of the third ring 1010 to bear on the drum skin 26 causing the drum skin 26 to apply an axially radiating force to the drum shell 12 via the third ring 1010.

Figure 11:
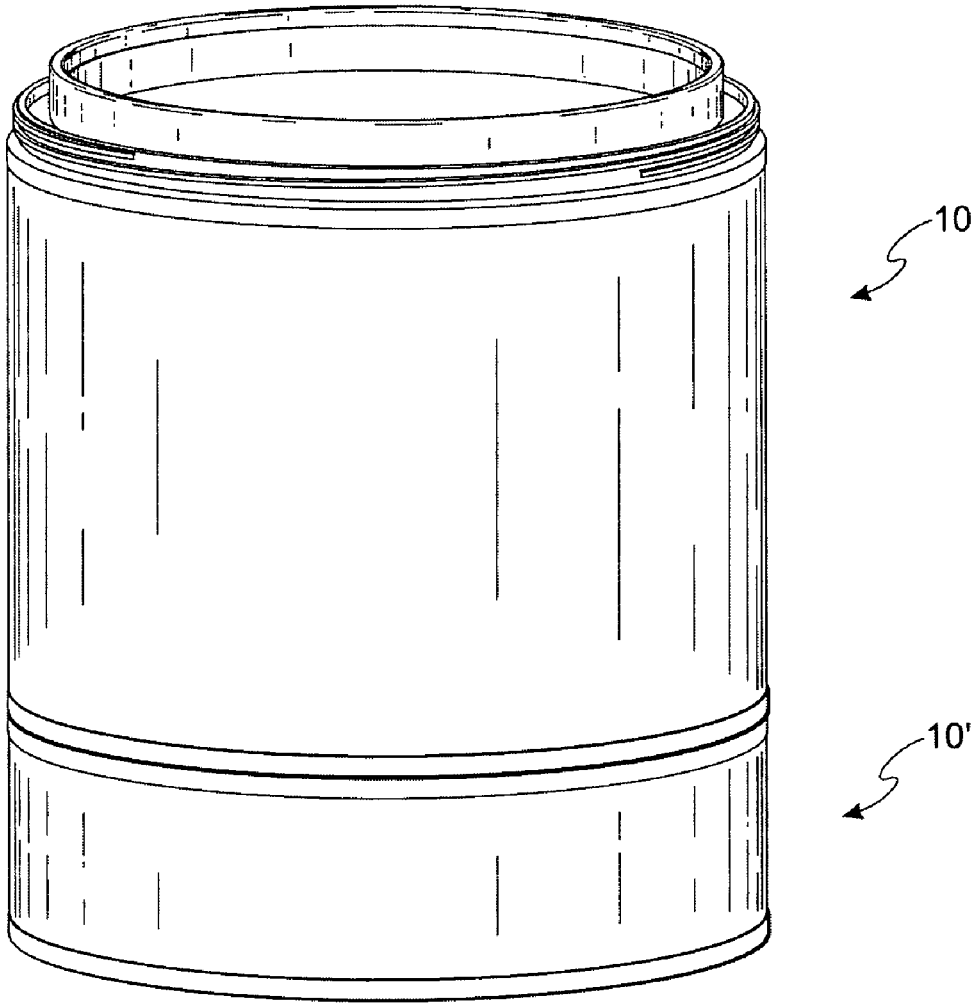
FIG. 11 is a perspective view of another embodiment of the present invention.

To further increase the versatility of the sound, a shell ring 301, 302 or counterhoop 32 may comprise additional threads 1050 on the outer surface or the inner surface of the shell ring 301, 302 or counterhoop 32 so that a second drum 10' may be screwed onto the first drum as shown in FIG. 11. In some embodiments, the top shell ring 301 or counterhoop 32 may be threaded on the inner surface and have a slightly larger diameter than the bottom rim or counterhoop 32. The bottom shell ring 302 or counterhoop 32 may have threads on the outer surface. Then the second drum 10' with similar top shell ring 301 or counterhoop 32 and bottom shell ring 302 or counterhoop 32 configurations can have the top shell ring 301 or counterhoop threaded onto the bottom shell ring 302 or counterhoop 32 of the first drum 10. Alternatively, the bottom shell ring 302 or counterhoop 32 may have a larger diameter than the top shell ring 301 or counterhoop 32 and the top shell ring 301 or counterhoop 32 of a second drum 10' may be threaded into the bottom shell ring 302 or counterhoop 32 of the first drum 10. With this arrangement, the bottom drum functions like a woofer for the first drum.

With the hardware from the drum shell removed, there is also more flexibility in the process for manufacturing drum shells 12. For example, there is more flexibility in the types of wood used without compromising sound quality or comfort. In addition, there is more flexibility in the shape of the drum shells 12 to produce more varied sounds from a single drum.

Due to the removal of the hardware from the drum shell, thinner drum shells may be produced with harder woods without compromising sound quality or substantially increasing drum weight. The drum shell is preferably made of hardwoods such as alder, ash, aspen, basswood, beech, birch, cherry, cottonwood, cypress, elm, gum, hackberry, hard maple, hickory and pecan, pacific coast maple, poplar, red oak, sassafras, soft maple, sycamore, walnut, white oak, and willow. Due to the increased density of the harder wood, sound quality is maintained over thicker, softwood drumshells. In addition, the thinner construction compensates for the increased density to keep the weight of the drum manageable.

In some embodiments, the drum shell 12 may also be manufactured using violin quality treated wood, specific as to aging, type of wood varnishes, and mineralized hardwoods into an open honeycomb-like state as opposed to sealed cells. At the microscopic level, the wood appears to have honeycomb-like cavities through which sounds may resonate.

In addition, in conventional drums, due to the hardware on the drum shells 12, the shape of the drums is limited. Most drums being cylindrical cause problems with flat hardware, such as a flat washer pressed against the cylindrical surface of the drum shell. Eliminating the hardware, allows for more varied drum sizes and shapes. For example, drum shells 12 having concave or convex interior surfaces are no longer restricted by the hardware. Goblet drums, such as the Djembe, and the hourglass drum, such as the Bata, are also less restricted.

Removing the hardware can also be applied to electronic drums. A special electronic drum with an active transducer trigger, being highly sensitive, will increase the dynamic range variables useful in a synchronized DrumBrain studio analyzer with memory, which measures sound variations in real time when variables on any drum containing any of these features is adjusted for recording and performance. A three-dimensional visual of harmonic content, frequency response, envelope, and amplitude may be displayed. Memory can deliver sound samples and/or resynthesis parameters to a digital to analog converter which can build a library of tunings which can be integrated into an overall drum or percussion set up and triggered from the trigger equipped drum set or trigger pads. This is a complete digital workstation for sequencing, processing, mixing and playback/CD burning which prints channel assignments for using drumming vocabulary instruction sets. The workstation is also an internet integrated drum and percussion production system which takes full advantage of the expanded flexibility of the drum system of the present invention in contemporary electronically interfaced drumsets especially of studio to live performance recall of fixed parameters.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A percussion instrument, comprising:

a. a drum shell having a cylindrical, outer wall centered about a drum shell axis, the drum shell having a first end and a second end;

b. a first drum skin and a second drum skin stretched across and covering the first end and the second end, respectively;

c. a first tuning system and a second tuning system operatively connected to the first end and the second end, respectively, to secure the first and second drum skins to the first and second ends of the drum shell, each tuning system comprising:

i. a tuning collar secured to the drum shell, wherein the tuning collar comprises:

1. a tuning rim having an externally, threaded outer surface, 2. an annular bearing rim disposed coaxially with the tuning rim and separated therefrom, and 3. a curved connecting region connecting the tuning rim and the bearing rim, the tuning rim, the annular bearing rim and the curved connecting region defining an annular channel, wherein the drum skin resides in contact with the bearing rim, the drum skin having a peripheral region extending radially outwardly beyond the bearing rim and into the annular channel;

ii. an annular hoop of circular cross section secured to the peripheral region of the drum skin and residing in the annular channel, wherein the peripheral region of the drum skin is firmly attached to and immobilized relative to the hoop;

iii. an annular counterhoop, having an inverted, generally U-shaped cross section formed with a downwardly facing, annular groove therein that receives the tuning rim, the counterhoop comprising 1. an outer tensioning band with radially inwardly directed screw threads defined thereon,
2. an inner, annular pressure ring that resides in the annular channel of the tuning collar and bears longitudinally against the hoop,
3. a bridging portion rigidly joining the tensioning band to the pressure ring, the bridging portion spanning the tuning rim and passing thereover in spaced, longitudinal separation therefrom, wherein the drum skin is tightened across the bearing rim by rotating the tensioning band in a first direction further onto the tuning rim and is loosened by rotating the tensioning band from the tuning rim in a second direction, opposite the first direction;

d. a snare strainer system attached to the counterhoop of the second tuning system so that the snare strainer system is rotatable with the counterhoop of the second tuning system, wherein the snare strainer system, comprises:

1. a cradle having a length and a width;
2. a strainer stretched along and secured to the cradle, the strainer having a tension; and
3. a cradle adjustment system to move the cradle and the strainer against and away from the drum skin while maintaining the tension in the strainer, wherein the cradle adjustment system, comprise a first and a second endplate positioned on opposite ends of the cradle, each endplate comprising:
   a) a clamp to secure the endplate to the counterhoop;
   b) a throw-off lever operatively connecting the endplate to the clamp to toggle the endplate between a first position that places the cradle against the drum skin and a second position that places the cradle away from the drum skin; and
   c) a cradle adjustment member having a first and second end, the first end of the cradle adjustment member movably connected to the endplate and the second end of the cradle adjustment member connected to the cradle.

2. The percussion instrument of claim 1, wherein the cradle comprises tracks, wherein each track is associated with a strainer wire.

3. The percussion instrument of claim 2, wherein each track comprises a groove into which the strainer wire is positioned to allow movement of the snare wire in a longitudinal direction towards the drum skin while reducing movement in a lateral direction.

4. The percussion instrument of claim 1, further comprising shims placed intermittently along the cradle in between the cradle and the strainer to provide shock absorption for the strainer.

5. The percussion instrument of claim 1, wherein the snare strainer system further comprise a tension spool, wherein the snare wires are securely wrapped around the tension spool and are tightened or loosened by rotating the tension spool.

6. The percussion instrument of claim 1, wherein the bearing rim comprises a bearing edge that is positioned away from a drum skin fold.

7. The percussion instrument of claim 6, wherein the bearing rim comprises an elliptically inward-curving shape.

8. The percussion instrument of claim 6, wherein the bearing edge comprises a proximal surface sloping radially inwardly towards the drum shell axis, thereby defining an angle between the proximal surface of the bearing edge and the drum skin, wherein the angle is between approximately 0 degrees to approximately 90 degrees.

9. The percussion instrument of claim 6, wherein the bearing edge is made from a mineral selected from the group consisting of synthetic sapphire and ceramic.

10. The percussion instrument of claim 1, wherein the bearing rim comprises a tunnel passing through the entire perimeter of the bearing rim just below the bearing edge to enhance a sound generated from a rimshot.

11. The percussion instrument of claim 1, wherein the bearing rim comprises a removable bearing edge.

12. The percussion instrument of claim 1, wherein the bearing rim is constructed of a metal alloy, the bearing rim having a grain, wherein the bearing rim is positioned on the drum shell such that the grain of the bearing rim is parallel to a grain of the drum shell.

13. The percussion instrument of claim 1, wherein the bearing rim has a ring tone configured to match a shell tone of the drum shell.

14. The percussion instrument of claim 1, further comprising tone coats affixed to the drum shell.

15. The percussion instrument of claim 14, wherein the tone coats comprise a crushed material selected from the group consisting of a mineral and a metal.

16. The percussion instrument of claim 1, wherein the drum shell comprises honeycomb-like cavities through which sound may resonate.

17. A percussion instrument, comprising:

a. a drum shell having a cylindrical, outer wall centered about a drum shell axis, the drum shell having a first end and a second end;

b. a first drum skin and a second drum skin stretched across and covering the first end and the second end, respectively;

c. a first tuning system and a second tuning system operatively connected to the first end and the second end, respectively, to secure the first and second drum skins to the first and second ends of the drum shell, each tuning system comprising:

i. a tuning collar secured to the drum shell, wherein the tuning collar comprises:
   a) a tuning rim having an externally, threaded outer surface,
   b) an annular bearing rim disposed coaxially with the tuning rim and separated therefrom, and
   c) a curved connecting region connecting the tuning rim and the bearing rim, the tuning rim, the annular bearing rim and the curved connecting region defining an annular channel, wherein the drum skin resides in contact with the bearing rim, the drum skin having a peripheral region extending radially outwardly beyond the bearing rim and into the annular channel;

ii. an annular hoop of circular cross section secured to the peripheral region of the drum skin and residing in the annular channel, wherein the peripheral region of the drum skin is firmly attached to and immobilized relative to the hoop;

iii. an annular counterhoop, having an inverted, generally U-shaped cross section formed with a downwardly facing, annular groove therein that receives the tuning rim, the counterhoop comprising a) an outer tensioning band with radially inwardly directed screw threads defined thereon, b) an inner, annular pressure ring that resides in the annular channel of the tuning collar and bears longitudinally against the hoop, c) a bridging portion rigidly joining the tensioning band to the pressure ring, the bridging portion spanning the tuning rim and passing thereover in spaced, longitudinal separation therefrom, wherein the drum skin is tightened across the bearing rim by rotating the tensioning band in a first direction further onto the tuning rim and is loosened by rotating the tensioning band from the tuning rim in a second direction, opposite the first direction;

d. a snare strainer system attached to the counterhoop of the second tuning system so that the snare strainer system is rotatable with the counterhoop of the second tuning system, wherein the bearing rim comprises air vents intermittently dispersed throughout the bearing rim to enhance the sound characteristics of a rimshot.

18. A percussion instrument, comprising:

a. a drum shell having a cylindrical, outer wall centered about a drum shell axis, the drum shell having a first end and a second end;

b. a first drum skin and a second drum skin stretched across and covering the first end and the second end, respectively;

c. a first tuning system and a second tuning system operatively connected to the first end and the second end, respectively, to secure the first and second drum skins to the first and second ends of the drum shell, each tuning system comprising:

i. a tuning collar secured to the drum shell, wherein the tuning collar comprises:

a) a tuning rim having an externally, threaded outer surface, b) an annular bearing rim disposed coaxially with the tuning rim and separated therefrom, and c) a curved connecting region connecting the tuning rim and the bearing rim, the tuning rim, the annular bearing rim and the curved connecting region defining an annular channel, wherein the drum skin resides in contact with the bearing rim, the drum skin having a peripheral region extending radially outwardly beyond the bearing rim and into the annular channel;

ii. an annular hoop of circular cross section secured to the peripheral region of the drum skin and residing in the annular channel, wherein the peripheral region of the drum skin is firmly attached to and immobilized relative to the hoop;

iii. an annular counterhoop, having an inverted, generally U-shaped cross section formed with a downwardly facing, annular groove therein that receives the tuning rim, the counterhoop comprising a) an outer tensioning band with radially inwardly directed screw threads defined thereon, b) an inner, annular pressure ring that resides in the annular channel of the tuning collar and bears longitudinally against the hoop, c) a bridging portion rigidly joining the tensioning band to the pressure ring, the bridging portion spanning the tuning rim and passing thereover in spaced, longitudinal separation therefrom, wherein the drum skin is tightened across the bearing rim by rotating the tensioning band in a first direction further onto the tuning rim and is loosened by rotating the tensioning band from the tuning rim in a second direction, opposite the first direction;

d. a snare strainer system attached to the counterhoop of the second tuning system so that the snare strainer system is rotatable with the counterhoop of the second tuning system, the drum shell further comprising an external plating extending from the tuning collar parallel to a grain of the drum shell.

19. The percussion instrument of claim 18, wherein the external plating is countersunk into the surface of the drum shell as an extension of the tuning collar.

20. The percussion instrument of claim 18, wherein the external plating extends from the first tuning collar to the second tuning collar.

21. A percussion instrument, comprising:

a. a drum shell having a cylindrical, outer wall centered about a drum shell axis, the drum shell having a first end and a second end;

b. a first drum skin and a second drum skin stretched across and covering the first end and the second end, respectively;

c. a first tuning system and a second tuning system operatively connected to the first end and the second end, respectively, to secure the first and second drum skins to the first and second ends of the drum shell, each tuning system comprising:

i. a tuning collar secured to the drum shell, wherein the tuning collar comprises:

a) a tuning rim having an externally, threaded outer surface, b) an annular bearing rim disposed coaxially with the tuning rim and separated therefrom, and c) a curved connecting region connecting the tuning rim and the bearing rim, the tuning rim, the annular bearing rim and the curved connecting region defining an annular channel, wherein the drum skin resides in contact with the bearing rim, the drum skin having a peripheral region extending radially outwardly beyond the bearing rim and into the annular channel;

ii. an annular hoop of circular cross section secured to the peripheral region of the drum skin and residing in the annular channel, wherein the peripheral region of the drum skin is firmly attached to and immobilized relative to the hoop;

iii. an annular counterhoop, having an inverted, generally U-shaped cross section formed with a downwardly facing, annular groove therein that receives the tuning rim, the counterhoop comprising a) an outer tensioning band with radially inwardly directed screw threads defined thereon, b) an inner, annular pressure ring that resides in the annular channel of the tuning collar and bears longitudinally against the hoop, c) a bridging portion rigidly joining the tensioning band to the pressure ring, the bridging portion spanning the tuning rim and passing thereover in spaced, longitudinal separation therefrom, wherein the drum skin is tightened across the bearing rim by rotating the tensioning band in a first direction further onto the tuning rim and is loosened by rotating the tensioning band from the tuning rim in a second direction, opposite the first direction;

d. a snare strainer system attached to the counterhoop of the second tuning system so that the snare strainer system is rotatable with the counterhoop of the second tuning system, wherein the second counterhoop further comprises threads configured to engage a threaded shell ring of a second drum.

22. A percussion instrument, comprising a. a drum shell having a cylindrical, outer wall centered about a drum shell axis, the drum shell having a first end and a second end;

b. a tuning system, comprising:

i. a first ring having an inverted, generally U-shaped cross section formed with a downwardly facing, annular groove therein, the first ring, comprising:

1. an outer tensioning band with radially inwardly directed screw threads defined thereon,
2. an inner, annular pressure ring parallel to the outer tensioning band and positioned radially inward relative to the outer tensioning band,
3. a bridging portion rigidly joining the outer tensioning band to the pressure ring, thereby forming the downwardly facing, annular groove;

ii. a second ring operatively connected to the first ring, the second ring, comprising:

1. a tuning rim insertable into the downwardly facing, annular groove of the first ring, wherein the tuning rim comprises a first end and a second end opposite the first end, the first end having an externally threaded, radially outwardly facing, outer surface with screw threads operatively engageable with the radially inwardly directed screw threads of the tensioning band, the second end having an internally threaded, radially inwardly facing, inner surface with screw threads defined coaxially thereon relative to the drum shell axis,
2. a first bearing rim disposed coaxially with the tuning rim and separated therefrom,
3. a connecting region rigidly joining the tuning rim and the first bearing rim, wherein the tuning rim, the first bearing rim and the connecting region defines an upwardly facing, annular channel configured to receive the inner annular pressure ring of the first ring;

iii. a third ring operatively connected to the second ring, the third ring comprising 1. externally-facing threads,
2. a second bearing rim, and
3. a connecting arm, rigidly fixing the second bearing rim relative to the exernally-facing threads, the internally-facing threads of the second ring operatively engaging the externally-facing threads of the third ring such that rotation of the second ring about the third ring in a first direction brings the bearing edge of the third ring closer to the drum skin;

c. a drum skin residing in contact with the first bearing rim throughout its circumference, the drum skin having a peripheral region extending radially outwardly beyond the first bearing rim and into the channel; wherein the drum skin is tightened across the first bearing rim by screwing the tensioning band further onto the tuning rim and is loosened by unscrewing the tensioning band from the tuning rim;

d. a closed, annular hoop of circular cross section secured to the peripheral region of the drum skin and residing in the channel, wherein the peripheral region of the drum skin is firmly attached to and immobilized relative to the hoop.

23. The percussion instrument of claim 22, further comprising a snare strainer system attached to a fourth ring at the bottom of the drum shell so that the snare system is rotatable with the fourth ring.

24. The percussion instrument of claim 23, wherein the bearing rim comprises a bearing edge that is positioned away from a drum skin fold.

25. The percussion instrument of claim 24, wherein the bearing rim comprises an elliptically inward-curving shape.

26. The percussion instrument of claim 24, wherein the bearing edge comprises a proximal surface sloping radially inwardly towards the drum shell axis, thereby defining an angle between the proximal surface of the bearing edge and the drum skin, wherein the angle is between approximately 0 degrees to approximately 90 degrees.

27. The percussion instrument of claim 24, wherein the bearing edge is made from a mineral selected from the group consisting of synthetic sapphire and ceramic.

28. The percussion instrument of claim 22, wherein the bearing rim comprises a tunnel passing through the entire perimeter of the bearing rim just below the bearing edge to enhance a sound generated from a rimshot.

29. The percussion instrument of claim 22, wherein the bearing rim comprises air vents intermittently dispersed throughout the bearing rim to enhance the sound characteristics of a rimshot.

30. The percussion instrument of claim 22, wherein the bearing rim comprises a removable bearing edge.

31. The percussion instrument of claim 22, wherein the bearing rim is constructed of a metal alloy, the bearing rim having a grain, wherein the bearing rim is positioned on the drum shell such that the grain of the bearing rim is parallel to a grain of the drum shell.

32. The percussion instrument of claim 22 further comprising an external plating extending from the tuning collar parallel to a grain of the drum shell.

33. The percussion instrument of claim 32, wherein the external plating is countersunk into the surface of the drum shell as an extension of the tuning collar.

34. The percussion instrument of claim 32, wherein the external plating extends from the first tuning collar to the second tuning collar.

35. The percussion instrument of claim 22, further comprising tone coats affixed to the drum shell.

36. The percussion instrument of claim 35, wherein the tone coats comprise a crushed material selected from the group consisting of a mineral and a metal.

37. The percussion instrument of claim 22, wherein the second counterhoop further comprises threads configured to engage a threaded shell ring of a second drum.

* * * * *